US005301842A

United States Patent [19]

Ritter

[11] Patent Number: 5,301,842

[45] Date of Patent: Apr. 12, 1994

[54] MULTICOMPONENT CARTRIDGE FOR PLASTIC MATERIALS

[76] Inventor: Frank Ritter, Schwibbogenmauer 18, D-8900 Augsburg, Fed. Rep. of Germany

[21] Appl. No.: 839,428

[22] Filed: Feb. 21, 1992

[30] Foreign Application Priority Data

Mar. 6, 1991 [DE] Fed. Rep. of Germany ..... 9102635
Mar. 6, 1991 [DE] Fed. Rep. of Germany ..... 9102636

[51] Int. Cl.[5] ..... B67D 5/52

[52] U.S. Cl. ..... 222/137; 222/145; 222/548; 220/617

[58] Field of Search ..... 222/135-137, 222/144.5, 145, 482-484, 548, 555; 220/610-619

[56] References Cited

U.S. PATENT DOCUMENTS

| | | |
|---|---|---|
| 1,342,060 | 10/1924 | Schmucker . |
| 1,342,450 | 6/1920 | Kost . |
| 1,961,173 | 6/1934 | Schutte et al. . |
| 2,111,582 | 3/1938 | Crewe . |
| 2,750,900 | 6/1956 | Moore . |
| 2,788,159 | 4/1957 | Crewe . |
| 2,826,339 | 3/1958 | Maillard . |
| 2,838,210 | 6/1958 | Detrie et al. . |
| 2,890,836 | 6/1959 | Gusmer et al. . |
| 2,941,699 | 6/1960 | Schmidt et al. . |
| 2,973,883 | 3/1961 | Modderno . |
| 3,028,052 | 4/1962 | Archer . |
| 3,076,225 | 2/1963 | Sherbondy . |
| 3,135,428 | 6/1964 | Gallo, Sr. . |
| 3,138,303 | 6/1964 | Hoveland . |
| 3,144,966 | 8/1964 | Cook . |
| 3,182,860 | 5/1965 | Gallo, Sr. . |
| 3,188,056 | 6/1965 | Trumbull et al. . |
| 3,215,320 | 11/1965 | Heisler et al. . |
| 3,227,319 | 1/1966 | Rosier . |

(List continued on next page.)

FOREIGN PATENT DOCUMENTS

| | | |
|---|---|---|
| 10913 | 9/1956 | Fed. Rep. of Germany . |
| 428221 | 6/1911 | France . |
| 545812 | 1/1922 | France . |
| 776329 | 7/1934 | France . |
| 2301306 | 6/1954 | France . |
| 495181 | 6/1954 | Italy . |
| 86320 | 9/1957 | Netherlands . |
| 27106 | of 1897 | United Kingdom . |
| 747286 | 3/1956 | United Kingdom . |
| 793277 | 4/1958 | United Kingdom . |
| 1102482 | 4/1966 | United Kingdom . |
| 1132408 | 10/1968 | United Kingdom . |

*Primary Examiner*—Andres Kashnikow
*Assistant Examiner*—Kenneth DeRosa
*Attorney, Agent, or Firm*—Oliff & Berridge

[57] ABSTRACT

An apparatus proportions and dispenses at least two different plastic materials such as, two component adhesives or sealants in which the components are stored separately from one another before use and are mixed with one another only for use. The apparatus includes a multichamber cartridge made from injection-molded plastic with at least two cartridge tube wall parts located one inside the other to form at least two chambers that receive one material component each. An end wall part is located at the anterior end of the cartridge tube wall parts on which a mouthpiece for dispensing the plastic material components from the cartridge is formed. Piston elements are inserted in the rear end of the cartridge tube wall parts to express the material components. The end wall part is formed as a separate head piece and the cartridge tube wall parts likewise are formed from two separately manufactured parts. Snap connections are provided to connect the cartridge tube wall parts with the head piece. The invention allows the cartridge tube wall parts and the cartridge end wall part each to be manufactured separately, so that the required injection-molding tools can be very simple in design and inexpensive. The injection-molding tools for the tube wall parts do not require any lateral slide functions, and the necessity for residual lateral slide functions is reduced to the injection-molding tool for the relatively small cartridge end wall part.

20 Claims, 4 Drawing Sheets

U.S. PATENT DOCUMENTS

| | | | |
|---|---|---|---|
| 3,272,389 | 9/1966 | Frangos . | |
| 3,302,832 | 2/1967 | Hardman et al. . | |
| 3,323,682 | 6/1967 | Creighton, Jr. et al. . | |
| 3,330,444 | 7/1967 | Raypholtz . | |
| 3,370,754 | 2/1968 | Cook et al. . | |
| 3,386,992 | 11/1966 | Armeniades et al. . | |
| 3,390,814 | 7/1968 | Creighton, Jr. et al. . | |
| 3,494,359 | 2/1970 | Zackheim . | |
| 3,543,967 | 12/1970 | O'Connor . | |
| 3,556,348 | 1/1971 | Bristow . | |
| 3,581,940 | 6/1971 | Cella . | |
| 3,620,417 | 11/1971 | Simms . | |
| 3,658,213 | 4/1972 | Plumer . | |
| 3,739,947 | 6/1973 | Baumann et al. . | |
| 3,767,085 | 10/1973 | Cannon et al. . | |
| 3,815,791 | 6/1974 | Clark . | |
| 3,827,602 | 8/1974 | Nicholls . | |
| 3,846,373 | 7/1989 | Penn et al. . | |
| 4,240,566 | 12/1980 | Bergman . | |
| 4,243,166 | 4/1987 | Adams . | |
| 4,271,984 | 6/1981 | Ducros et al. . | |
| 4,340,154 | 7/1982 | VanManen . | |
| 4,366,919 | 1/1983 | Anderson . | |
| 4,432,469 | 2/1984 | Eble et al. . | |
| 4,538,920 | 9/1985 | Drake | 222/145 X |
| 4,690,306 | 9/1987 | Staheli | 222/137 X |
| 4,705,192 | 11/1987 | Knapton | 222/144.5 |
| 4,771,919 | 9/1988 | Ernst | 222/145 X |
| 4,832,235 | 5/1989 | Palmer | 222/548 X |
| 4,838,457 | 6/1989 | Swahl et al. | 222/144.5 X |
| 4,881,821 | 11/1989 | Stutz | 222/145 X |
| 4,893,729 | 1/1990 | Iggulden et al. | 222/145 X |
| 4,969,747 | 11/1990 | Colin et al. | 222/145 X |
| 5,027,981 | 7/1991 | Magister | 222/145 X |
| 5,033,650 | 7/1991 | Colin et al. | 222/145 X |
| 5,115,946 | 5/1992 | Libit | 222/145 |

MULTICOMPONENT CARTRIDGE FOR PLASTIC MATERIALS

BACKGROUND OF THE INVENTION

1. Field of the Invention

The invention relates to multicomponent cartridges for proportioning and dispensing at least two different plastic materials such as, two-component adhesives or sealants in which the components are stored separately from one another before use and are mixed with one another only for use.

2. Description of the Related Art

The invention relates in particular, to a multichamber cartridge made from injection-molded plastic for proportioning and dispensing two or more component plastic materials, with at least two cartridge tube wall parts located one inside the other to form at least two chambers that receive one material component each, an end wall part located at the anterior end of the cartridge tube wall parts on which a mouthpiece for dispensing the plastic material components from the cartridge is formed, and with piston elements inserted in the rear end of the cartridge tube wall parts to express the material components.

Such two-chamber cartridges for two-component materials with cartridge tube wall parts located coaxially within one another are already known; see for example U.S. Pat. 2,826,339 (Maillard), U.S. Pat. No. 4,366,919 (Anderson), and U.S. Pat. No. 4,846,373 (penn et al). In the known two-chamber cartridges, the tube wall parts and the end wall part are produced integrally with one another in one injection-molding process from plastic requiring a correspondingly complicated and expensive injectionmolding tool.

The known two-chamber cartridges according to U.S. Pat. No. 2,826,339 and U.S. Pat. No. 4,846,373 are also provided with shutoff valves at the outlet, which are designed to prevent the material from continuing to flow when the pressure on the piston elements is released. In U.S. Pat. No. 2,826,339, these shutoff valves are designed as check valves and are mounted separately in the outlet channel of each chamber. The shutoff valve described in U.S. Pat. No. 4,846,373 has a rotatable valve plug located crosswise in a projecting neck on the cartridge end wall, with two parallel cross bores, said bores being brought into and out of alignment with the two outlet channels of the two chambers by rotating the valve plug.

SUMMARY OF THE INVENTION

An object of the invention is to improve a multichamber cartridge of the type recited above in such fashion that it can be manufactured readily using simpler injection-molding tools.

Another object of the invention is to enable the manufacture of two-chamber cartridges for different mixing ratios of the two components with reduced injection-molding tool expense.

An additional object of the invention is to provide an improved shutoff valve at the outlet of a multichamber cartridge.

The invention accordingly comprises a multichamber cartridge manufactured from injection-molded plastic for two or multicomponent plastic materials, with at least two cartridge tube wall parts located inside one another to form at least two chambers to receive one material component each, an end wall part located at the anterior end of the cartridge tube wall parts on which a mouthpiece to dispense the material components from the cartridge is formed, piston elements inserted in the rear end of the cartridge tube wall parts to express the material components, with the end wall part being formed as a separate head piece and the cartridge tube wall parts likewise being formed from two separately manufactured parts, and with snap connections being provided to connect the cartridge tube wall parts with the head piece.

The multichamber cartridge according to the invention allows the cartridge tube wall parts and the cartridge end wall part to be each manufactured separately, so that the required injection-molding tools can be very simple in design and inexpensive. The injection-molding tools for the tube wall parts do not require any lateral slide functions, and the necessity for residual lateral slide functions is reduced to the injection-molding tool for the relatively small cartridge end wall part.

In addition, the multichamber cartridge according to the invention offers the possibility of reacting much more flexibly and rapidly to short-term changes in the cartridge mixing ratio. For example, in a double coaxial cartridge only the diameter of the cartridge inner tube, that is, only the simple tool related thereto, is changed and/or built new. In particular, the end wall part can be designed for a plurality of different inner tube diameters to be mounted optionally.

The undercuts required to achieve the snapping feature are designed so that they can be made in an injection-molding tool without lateral slide functions and snapping is achievable by elastic shaping of the material. Accordingly, the radial dimension of the undercuts fluctuates in the range of tenths of a millimeter.

Further, the invention comprises a multichamber cartridge manufactured from injection-molded plastic for two or multicomponent plastic materials, with at least two cartridge tube wall parts located one inside the other to form at least two chambers, each to receive one material component, an end wall part located at the anterior end of the cartridge tube wall parts, on which a mouthpiece to dispense the material components from the cartridge is formed, said mouthpiece communicating with each chamber by an outlet opening formed in the end wall part. Piston element are inserted in the rear end of the cartridge tube wall end parts to express the material components, and a mouthpiece shutoff device is associated with the mouthpiece for optional closure or opening of the mouthpiece, which has a shutoff element rotatable between an open position and a closed position. The shutoff element has a disk which is located in the mouthpiece of the cartridge transversely to the material flow direction, directly in front of the outlet openings of the mouthpiece, and is rotatable around an axis parallel to the lengthwise axis of the cartridge. The disk in turn has through openings which are brought into and out of alignment with the outlet openings of the mouthpiece by rotating the disk between the open and closed positions.

In the shutoff device, according to the invention, the actuating movement takes place as a rotary movement around an axis parallel to the lengthwise axis of the cartridge. This operation of the shutoff device is perceived as pleasant and easy. It can easily be performed with the hand holding the anterior end of the cartridge injection gun.

Other objects, advantages and salient features of the invention will become apparent from the following detailed description, which taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE PREFERRED EMBODIMENTS

Figure 1:
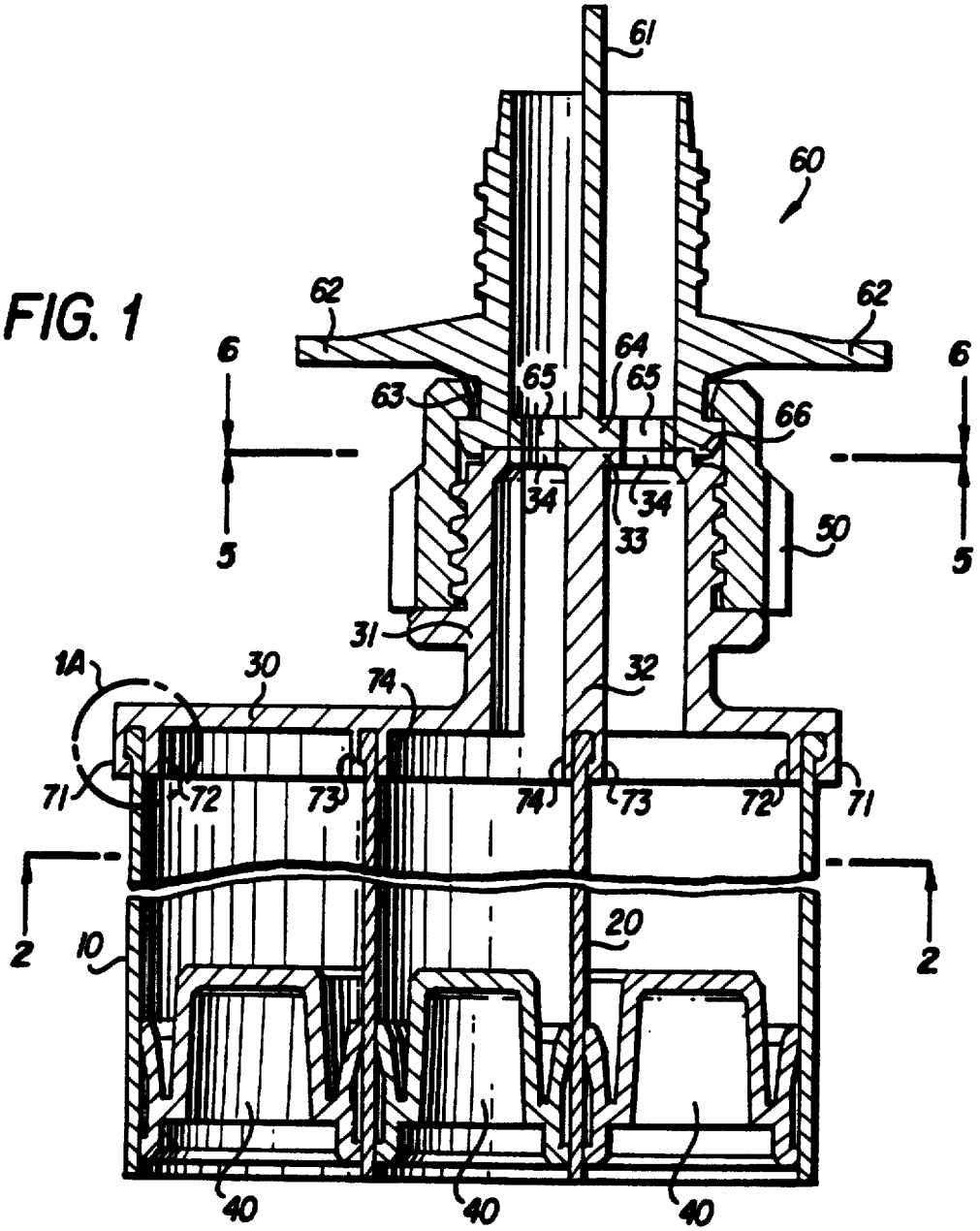
FIG. 1 is a lengthwise section through a two-chamber coaxial cartridge according to the invention with a shutoff device at the outlet of the cartridge.
Figure 2:
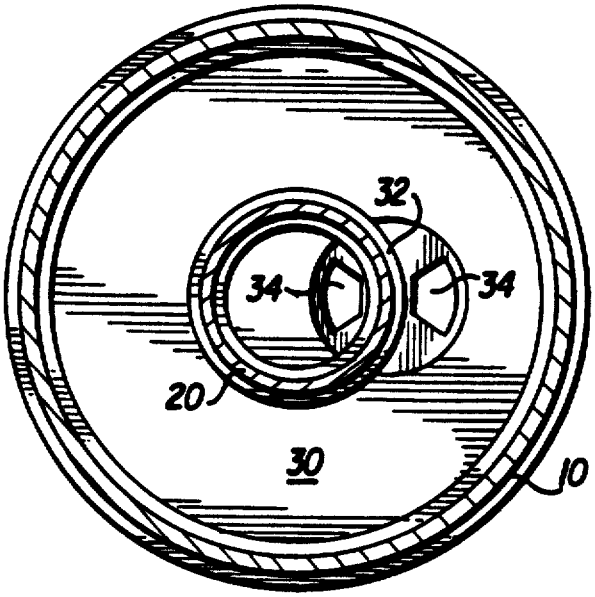
FIG. 2 is a cross section through the cartridge in FIG. 1 along line 2—2 in FIG. 1.

The double coaxial cartridge shown in FIG. 1 consists of a cartridge outer tube 10, a cartridge inner tube 20, a cartridge head piece 30 forming the end wall which is mounted on the anterior end of the cartridge tube, and suitable compression pistons 40 which are inserted at the rear ends of the cartridge tubes. A sealing mechanism 60 rotatable around its lengthwise axis is mounted on cartridge head piece 30 by means of a threaded sleeve 50, with a mixing jet screwable onto said mechanism 60. FIG. 2 shows openings 34 in cartridge head piece 30 which in the example shown in FIG. 1 are aligned with openings 65 of the shutoff mechanism.

As shown in FIG. 1, cartridge outer tube 10, cartridge inner tube 20, and cartridge head piece 30 each represent separate individual parts with cartridge tubes 10 and 20 being engaged in cartridge head piece 30. Cartridge ,head piece 30 also has coaxial cylindrical projections 71-74, which are arranged with a radial spacing corresponding to the wall thickness of the specific cartridge tube 10 or 20.

Figure 1A:
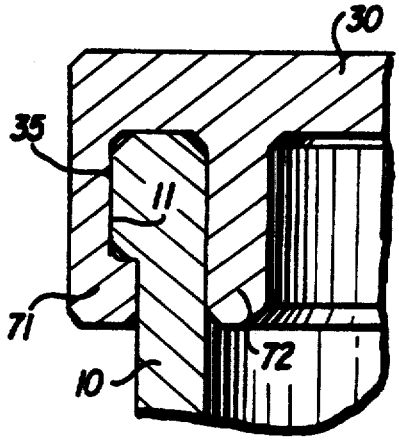
FIG. 1A is an enlargement of the detail 1A encircled in FIG. 1.

FIG. 1A shows enlarged detail 1A encircled in FIG. 1. It is evident that the exterior radial outer projection 71 of cartridge head piece 30 has an undercut 35 and cartridge outer tube 10 has a nose 11 matching undercut 35 which, in cooperation with projection 72, are engaged with one another. Both undercut 35 and nose 11 in the present embodiment extend continuously around the entire circumference of cartridge head piece 30 or cartridge outer tube 10. Analogously, interior radial outer projection 73 of cartridge head piece 30 which, in cooperation with projection 74, serves to fasten cartridge inner tube 20 has a corresponding undercut and cartridge inner tube 20, has a corresponding nose.

Preferably, undercut 35 is provided in the radially outer projection 71, 73, since when head piece 30 is manufactured and cartridge tubes 10 and 20 are engaged in projections 71-74, it is easier to bend corresponding projections 71 and 73 than in the reverse case, to swage projections 72 and 74.

Figure 7:
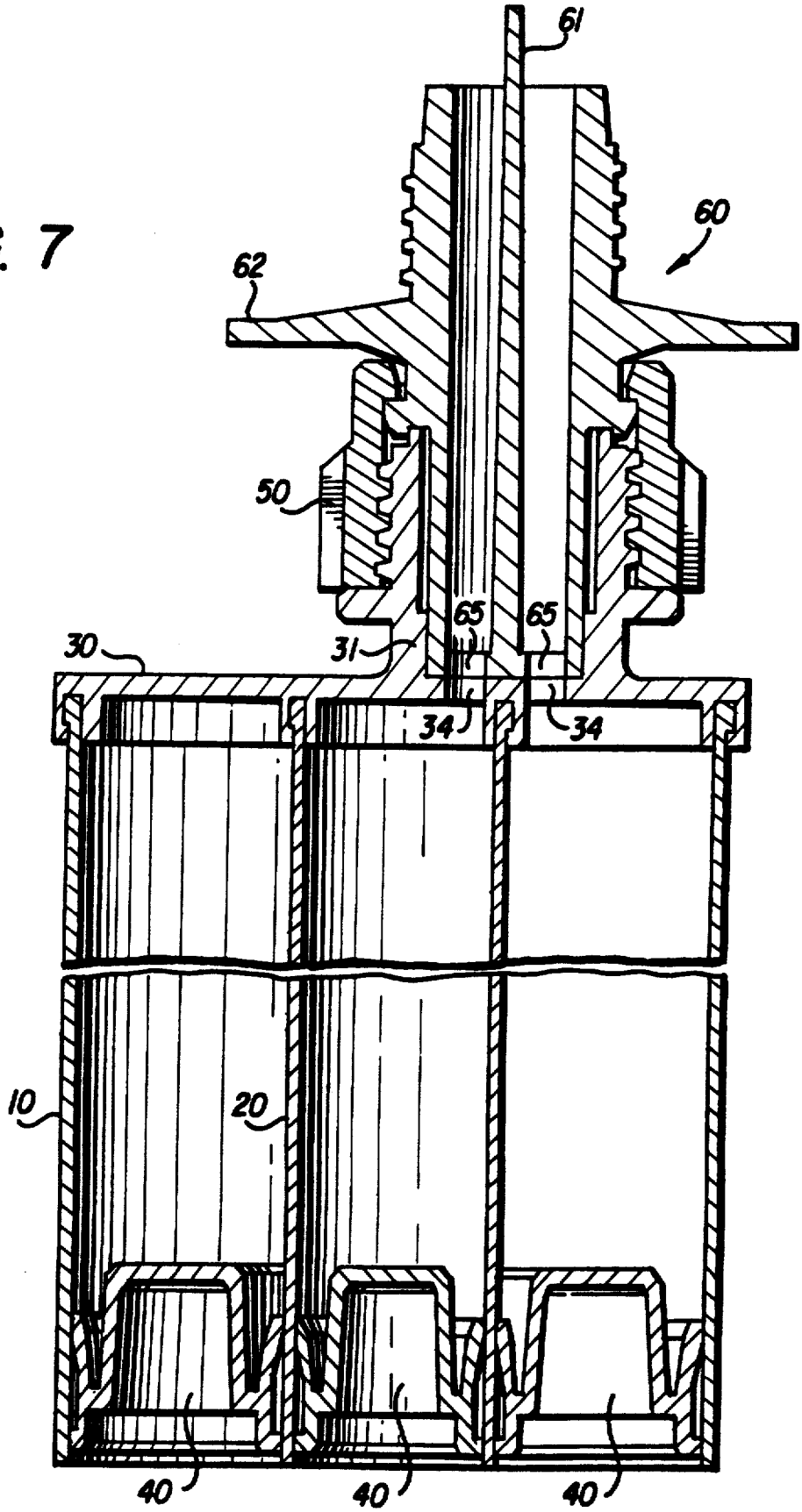
FIG. 7 is an alternative embodiment of the shutoff device in a lengthwise section.

For reasons of clarity, the radial extent of undercut 35 and nose 11 is shown exaggerated in FIGS. 1, 1A and 7; it actually has only very small dimensions and in the case of cartridges encountered in practice, lies in the tenth of a millimeter range.

The shutoff device on the cartridge head piece will now be described.

According to FIG. 1, cartridge head piece 30 has an eccentric neck 31 which is divided internally by a circular rib 32 into two material chambers each communicating with material chambers formed by cartridge tubes 10, 20. The neck 31 is provided externally with a thread.

This thread holds a threaded sleeve 50 which holds a shutoff element 60 rotatably on neck 31 of cartridge head piece 30.

Shutoff element 60 includes a hollow cylinder open at the top and divided by a central rib 61 into two partial cylinders, with thread for screwing on a mixing jet, for example, and with two wings 62 or other gripping element to actuate the shutoff element 60.

Threaded sleeve 50 engages a circumferential groove 63 of the shutoff element, with the overhang of this engagement being designed dimensionally so that a locking of the two parts made of plastic as a result of elastic material deformation and corresponding design of the flanks is made possible. By virtue of this engagement between threaded sleeve 50 and shutoff element 60, with suitably selected axial compressive force, rotation of shutoff element 60 relative to threaded sleeve 50 and neck 31 is possible.

Figure 3:
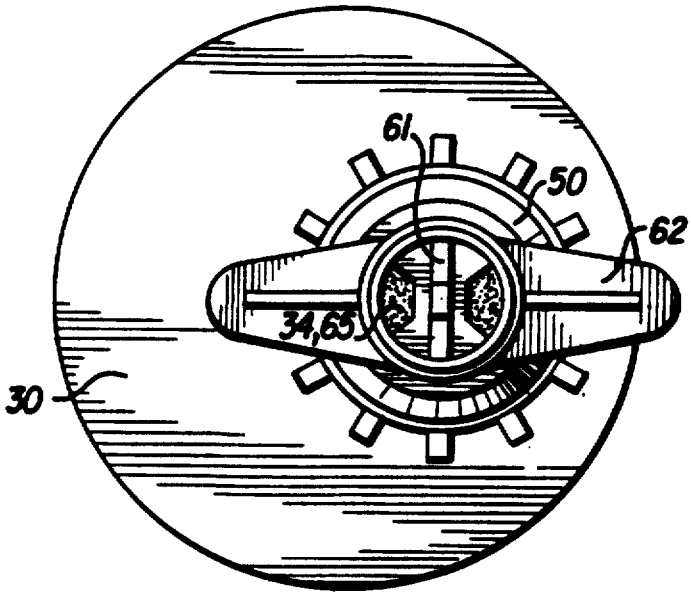
FIG. 3 is an end view of the cartridge shown in FIG. 1 with the shutoff element open.

Neck 31 of cartridge head piece 30 is sealed off by a bottom 33 at its end facing shutoff element 60, in which bottom two openings 34 are provided, with each opening being on one side of rib 32 and connecting accordingly with the respective material chamber (see also FIG. 2). A bottom 64 of cylinder 60 that forms the actual shutoff element has openings 65 which match the position and shape of openings 34, said openings 65 being shown in FIGS. 1 and 3 as above one another; this corresponds to the open position of shutoff element 60.

Figure 4:
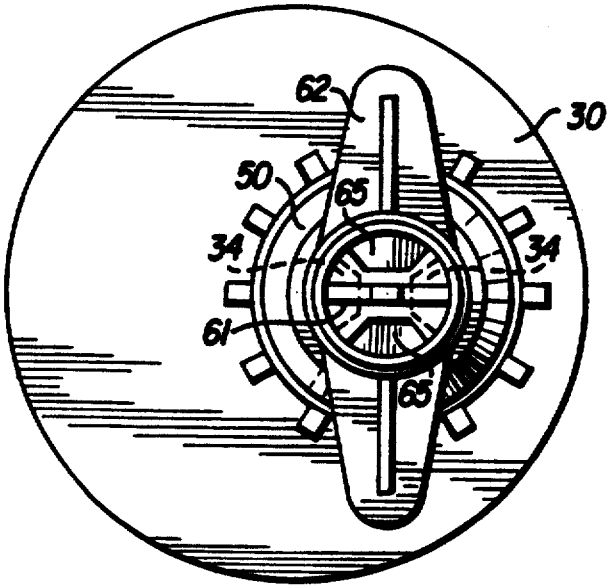
FIG. 4 is an end view as in FIG. 3, but with the shutoff element closed.

FIG. 4 illustrates the closed position of shutoff element 60. The shutoff element 60 has been rotated 90° around its lengthwise axis, so that the corresponding openings 34 of head piece 30 and openings 65 of shutoff element 60 no longer communicate and are therefore closed.

Figure 5:
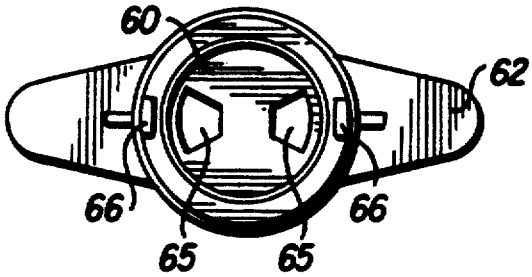
FIG. 5 is a bottom view of the shutoff element along line 5—5 in FIG. 1.
Figure 6:
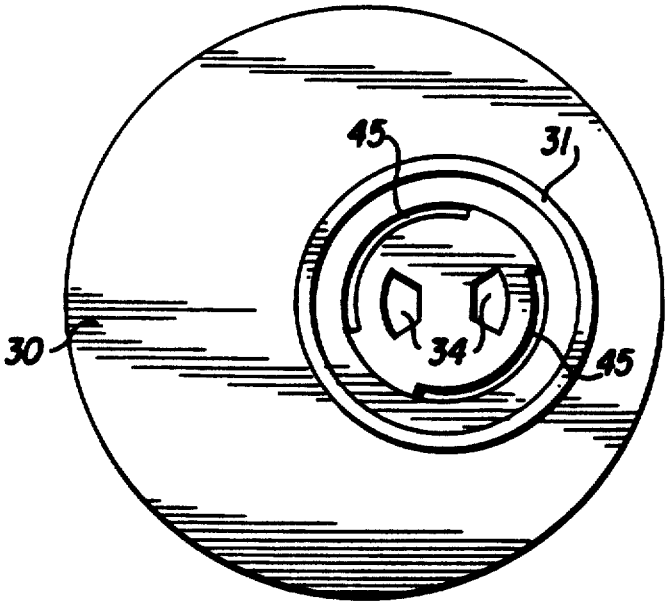
FIG. 6 is an end view of the head piece of the cartridge shown in FIG. 1 along line 6—6 in FIG. 1.

In order for shutoff element 60 to be twisted in a specific fashion, it is subjected to the forced guidance shown in FIGS. 5 and 6. In FIG. 5 shutoff element 60 has at its lower end two diametrally opposite projecting contact noses 66 which engage matching guide grooves 45 provided in bottom 33 of neck 31 (FIG. 6) and following suitable rotation of shutoff element 60, strike their limits so that specific open and closed positions are defined.

FIG. 7 shows another embodiment of the coaxial cartridge with a shutoff element 60 according to the invention. The only difference from the embodiment shown in FIG. 1 is that the arcuate rib 32 is practically completely missing, and the shutoff element 60 cylinder extends as far as the level formed by cartridge head piece 30. This embodiment is preferable to the one shown in FIG. 1 from the injection-molding standpoint as far as head piece 30 is concerned.

Finally, instead of the gripping element shown in the form of a strap with two wings 62, a single gripping lever extending laterally from shutoff element 60 may be used (not shown).

Although the invention has been shown and described with respect to preferred embodiments thereof, it should be understood by those skilled in the art that various changes in the form and detail thereof may be made therein without departing from the spirit and scope of the invention as defined in the appended claims.

I claim:

1. A multichamber cartridge of injection-molded plastic for at least two plastic materials with at least two cartridge tube wall parts located one inside the other to form at least two chambers to receive one material component each, the cartridge comprising:

an end wall part located at an anterior end of the cartridge tube wall parts, to which a mouthpiece to dispense the material components from the cartridge is formed, piston elements inserted in a rear end of the cartridge tube wall parts to express the material components, with the end wall part designed as a separate head piece and the cartridge tube wall parts made as separately manufactured parts, and snap connections on the cartridge tube wall parts and head piece for connecting the cartridge tube wall parts with the head piece, wherein the snap connections have, between said head piece and each cartridge tube wall parts, an annular flange formed on respective tube wall parts with an annular groove having an undercut, and an annular projection formed on said head piece complementary to the annular groove for engaging said undercut of the annular groove.

2. The multichamber cartridge according to claim 1, wherein said mouthpiece communicates with each chamber through an outlet opening formed in the end wall parts and a mouthpiece shutoff device associated with the mouthpiece for optional closure or opening of the mouthpiece, the mouthpiece shutoff device having a shutoff element rotatable between an open position and a closed position, said shutoff element having a disk located on the mouthpiece of the cartridge, transverse to the material flow direction and directly in front of outlet openings of the mouthpiece, and being rotatable around the axis parallel to the cartridge lengthwise axis, said disk having through openings which are brought into and out of alignment with outlet openings of the mouthpiece by rotating the disk between the open and closed positions.

3. The multichamber cartridge according to claim 2 for a two-component cartridge with two coaxial cartridge tubes whereby said disk forms the bottom of a cylinder open at the front, said disk having a jacket, the jacket including gripping means for actuating the shutoff element and a circumferential groove, in which a retaining means is engaged to guide and hold the cylinder on said head piece.

4. The multichamber cartridge according to claim 3, wherein the retaining means is a threaded sleeve screwed on a neck of said head piece.

5. A multichamber cartridge according to claim 3, wherein the cylinder is divided by a middle rib.

6. The multichamber cartridge according to claim 2, wherein the rotation of said disk between the open and closed positions is limited by stop surfaces formed on the disk in said mouthpiece.

7. The multichamber cartridge according to claim 2, wherein the through openings of said disk are congruent in shape with the outlet openings of said mouthpiece.

8. A multichamber cartridge according to claim 6, wherein said stop surfaces comprise two projecting stop noses which engage two suitably designed depressed guide grooves on the head piece, the guide grooves having ends forming a counterstop for said stop noses.

9. The multichamber cartridge according to claim 1, wherein said undercut is formed in a radial outer groove wall.

10. The multichamber cartridge according to claim 1, wherein the radial extent of said undercut is in the tenths of a millimeter range.

11. A multichamber cartridge of injection-molded plastic for at least two plastic materials with at least two cartridge tube wall parts located one inside the other to form at least two chambers to receive one material component each, the cartridge comprising:

an end wall part located at an anterior end of the cartridge tube wall parts, to which a mouthpiece to dispense the material components from the cartridge is formed, piston elements inserted in a rear end of the cartridge tube wall parts to express the material components, with the end wall parts designed as a separate head piece and the cartridge tube wall parts made as separately manufactured parts, and snap connections on the cartridge tube wall parts and head piece for connecting the cartridge tube wall parts with the head piece, wherein the snap connections have, between said head piece and each cartridge tube wall part, an annular flange formed on said head piece with an annular groove having an undercut, and an annular projection formed on respective tube wall parts complementary to the annular groove for engaging said undercut of the annular groove.

12. The multichamber cartridge according to claim 11, wherein the mouthpiece communicates with each chamber through an outlet opening formed in the end wall part and a mouthpiece shutoff device associated with the mouthpiece for optional closure or opening of the mouthpiece, the mouthpiece shutoff device having a shutoff element rotatable between an open position and a closed position, said shutoff element having a disk located on the mouthpiece of the cartridge, transverse to the material flow direction and directly in front of outlet openings of the mouthpiece, and being rotatable around the axis parallel to the cartridge lengthwise axis, said disk having through openings which are brought into and out of alignment with outlet openings of the mouthpiece by rotating the disk between the open and closed positions.

13. The multichamber cartridge according to claim 12, wherein the rotation of said disk between the open and closed positions is limited by stop surfaces formed on the disk in said mouthpiece.

14. A multichamber cartridge according to claim 13, wherein said stop surfaces comprises two projecting stop noses which engage two suitably designed depressed guide grooves on the head piece, the guide grooves having ends forming a counterstop for said stop noses.

15. The multichamber cartridge according to claim 12, wherein the through openings of said disk are congruent in shape with the outlet openings of said mouthpiece.

16. The multichamber cartridge according to claim 12, for a two-component cartridge with two coaxial cartridge tubes whereby said disk forms the bottom of a cylinder open at the front, said disk having a jacket, the jacket including gripping means for actuating the shut-off element and a circumferential groove, in which a retaining means is engaged to guide and hold the cylinder on said head piece.

17. The multichamber cartridge according to claim 16, wherein the retaining means is a threaded sleeve screwed on a neck of said head piece.

18. A multichamber cartridge according to claim 16, wherein the cylinder is divided by a middle rib.

19. The multichamber cartridge according to claim 11, wherein radial extent of said undercut is in the tenths of a millimeter range.

20. The multichamber cartridge according to claim 11, wherein said undercut is formed in a radial outer groove wall.

* * * * *